US012180712B1

(12) United States Patent
Wood

(10) Patent No.: US 12,180,712 B1
(45) Date of Patent: Dec. 31, 2024

(54) CORNER GUTTER DIVERTER

(71) Applicant: Michael James Wood, Marlborough, CT (US)

(72) Inventor: Michael James Wood, Marlborough, CT (US)

( * ) Notice: Subject to any disclaimer, the term of this patent is extended or adjusted under 35 U.S.C. 154(b) by 0 days.

(21) Appl. No.: 18/559,585

(22) PCT Filed: Jun. 8, 2023

(86) PCT No.: PCT/US2023/068109
§ 371 (c)(1),
(2) Date: Nov. 8, 2023

(87) PCT Pub. No.: WO2023/240172
PCT Pub. Date: Dec. 14, 2023

Related U.S. Application Data

(60) Provisional application No. 63/366,243, filed on Jun. 11, 2022.

(51) Int. Cl.
*E04D 13/068* (2006.01)
*E04D 13/064* (2006.01)

(52) U.S. Cl.
CPC ..... *E04D 13/068* (2013.01); *E04D 13/0643* (2013.01)

(58) Field of Classification Search
CPC ..... E04D 13/0459; E04D 13/0481; E04D 13/0643; E04D 13/076; E04D 2013/0454; E04D 2013/0486
(Continued)

(56) References Cited

U.S. PATENT DOCUMENTS 5,333,419 A * 8/1994 Hickner ..... E04D 13/04 52/60
5,673,520 A * 10/1997 Yannucci, III ..... E04D 13/1475 52/24

(Continued)

FOREIGN PATENT DOCUMENTS

JP 3188529 B2 * 7/2001

OTHER PUBLICATIONS

YISMAN, YISMAN Lavatory Bathroom Corner 304 Stainless Steel Shelf Wall Mount Triangular Shower corner Shelf, Brack [online], Sep. 4, 2019, [retrieved on Sep. 5, 2023. Retrieved from the internet: Mount Triangular Shower corner Shelf,Black [online], Sep. 4, 2019, [retrieved on Sep. 5, 2023]. Retrieved from the internet: <URL : https://www.amazon.com/Lavatory_Bathroom Corner Stainless Triangular/dp/BO86DJJRMWth=1 (YISMAN), entire Document.

*Primary Examiner* — Christine T Cajilig
(74) *Attorney, Agent, or Firm* — Matthew J Patterson

(57) ABSTRACT

A gutter diverter is disclosed may include providing a base having a generally triangular shaped planar section having a first leg, a second leg, and a third leg positioned at a periphery of the generally triangular shaped planar section. In addition, the gutter diverter may include forming a first attachment tab positioned on the first leg of the base and projecting orthogonally downwardly from the base. The gutter diverter may include forming a second attachment tab positioned on the second leg of the base and projecting orthogonally downwardly from the base. Moreover, the gutter diverter may include forming a diverter plate positioned on the third leg of the base and projecting orthogonally upwardly from the base.

20 Claims, 7 Drawing Sheets

(58) Field of Classification Search
USPC ..... 52/13
See application file for complete search history.

(56) References Cited

U.S. PATENT DOCUMENTS

| | | | | |
|---|---|---|---|---|
| 6,009,672 | A | 1/2000 | Kuhns | |
| D555,773 | S * | 11/2007 | Wallace | D25/199 |
| 7,765,743 | B2 * | 8/2010 | Guilford | E04D 13/0643 52/12 |
| 11,492,806 | B2 * | 11/2022 | Jones | E04D 13/0445 |
| 2002/0124476 | A1 | 9/2002 | Iannelli | |
| 2005/0115160 | A1 * | 6/2005 | Brochu | E04D 13/0481 52/11 |
| 2006/0090404 | A1 * | 5/2006 | Lovell | E04D 13/0481 52/97 |
| 2009/0107053 | A1 * | 4/2009 | Guilford | E04D 13/0643 52/12 |
| 2018/0179761 | A1 * | 6/2018 | Higginbotham | E04D 13/076 |
| 2019/0186139 | A1 * | 6/2019 | Piltch | E04D 1/28 |

* cited by examiner

CORNER GUTTER DIVERTER

CROSS-REFERENCE TO RELATED APPLICATION

This application claims the benefit of Patent Cooperation Treaty Patent Application Serial No. PCT/US 23/68109 filed 8 Jun. 2023 as well as U.S. Provisional Application Ser. No. 63/366,243 filed 11 Jun. 2022. The disclosure of these applications are incorporated herein by reference in their entirety.

BACKGROUND

The prior art is replete with devices and accessories for modifying and improving rain gutters for commercial and residential buildings.

SUMMARY

Some implementations herein relate to a method. For example, the method may include providing a base having a generally triangular shaped planar section having a first leg, a second leg, and a third leg positioned at a periphery of the generally triangular shaped planar section. The method may also include forming a first attachment tab positioned on the first leg of the base and projecting orthogonally downwardly from the base. The method may furthermore include forming a second attachment tab positioned on the second leg of the base and projecting orthogonally downwardly from the base. The method may in addition include forming a diverter plate positioned on the third leg of the base and projecting orthogonally upwardly from the base.

The described implementations may also include one or more of the following features. The method may include forming the first attachment tab, forming the second attachment tab and forming the diverter plate integrally with the base. The method may include attaching the gutter corner diverter to a pair of rain gutters, where the pair of rain gutters may include a first rain gutter and a second rain gutter, the pair of rain gutters forming a mitered corner at an inside eave corner formed by a pair of roof eaves, the first rain gutter having a first fascia face and a first front face, the second rain gutter having a second fascia face and a second front face, the mitered corner having an inside gutter corner formed by the first fascia face and the second fascia face positioned against the eave corner and an outside gutter corner formed by the first front face and the second front face, the method of providing for a gutter corner diverter may include positioning a portion of the base on a top of a front portion of the outside gutter corner, attaching the first attachment tab to a front lip of the first front face, and attaching the second attachment tab to a front lip of the second of the front face. The method where a valley is formed by a pair of roof sections and where the valley terminates proximate the eave corner, the method of providing for a gutter corner diverter may include positioning the base to receiver rainwater from the valley, positioning the diverter plate opposite the inside gutter corner, and diverting rainwater from the base to the diverter plate and into the pair of straight rain gutters. The method may include terminating a first end of the third leg proximate the first front face and terminating a second end of the third leg proximate the second front face. The method where the third leg has a length the method may include extending the diverter plate along at least a portion of the length of the third leg. The method may include extending the diverter plate beyond the length of the third leg.

Some implementations herein relate to a device. For example, the device may include a base having a generally triangular shaped planar section having a first leg, a second leg, and a third leg positioned at a periphery of the generally triangular shaped planar section. The device may also include a first attachment tab positioned on the first leg of the base and projecting orthogonally downwardly from the base. The device may furthermore include a second attachment tab positioned on the second leg of the base and projecting orthogonally downwardly from the base. The device may in addition include a diverter plate positioned on the third leg of the base and projecting orthogonally upwardly from the base.

The described implementations may also include one or more of the following features. The device may include the first attachment tab, the second attachment tab and the diverter plate formed integrally with the base. The device may include the gutter corner diverter configured to be attached to a pair of rain gutters, where the pair of rain gutters may include a first rain gutter and a second rain gutter, the pair of rain gutters forming a mitered corner at an inside eave corner formed by a pair of roof eaves, the first rain gutter having a first fascia face and a first front face, the second rain gutter having a second fascia face and a second front face, the mitered corner having an inside gutter corner formed by the first fascia face and the second fascia face positioned against the eave corner and an outside gutter corner formed by the first front face and the second front face, the method of providing for a gutter corner diverter may include positioning a portion of the base on a top of a front portion of the outside gutter corner attaching the first attachment tab to a front lip of the first front face, and attaching the second attachment tab to a front lip of the second of the front face. The device where a valley is formed by a pair of roof sections and where the valley terminates proximate the eave corner, the method of providing for a gutter corner diverter may include positioning the base to receiver rainwater from the valley positioning the diverter plate opposite the inside gutter corner, and diverting rainwater from the base to the diverter plate and into the pair of straight rain gutters. The device may include terminating a first end of the third leg proximate the first front face and terminating a second end of the third leg proximate the second front face. The device where the third leg has a length the method may include extending the diverter plate along at least a portion of the length of the third leg. The device may include extending the diverter plate beyond the length of the third leg.

Some implementations herein relate to a gutter corner diverter. For example, a gutter corner diverter may include a base having a generally triangular shaped planar section having a first leg, a second leg, and a third leg positioned at a periphery of the generally triangular shaped planar section. The gutter corner diverter may also include a first attachment tab positioned on the first leg of the base and projecting orthogonally downwardly from the base. The diverter may furthermore include a second attachment tab positioned on the second leg of the base and projecting orthogonally downwardly from the base. The diverter may in addition include a diverter plate positioned on the third leg of the base and projecting orthogonally upwardly from the base. Other embodiments of this aspect include corresponding computer systems, apparatus, and computer programs recorded on one or more computer storage devices, each configured to perform the actions of the methods.

The described implementations may also include one or more of the following features. The gutter corner diverter may include the first attachment tab, the second attachment tab and the diverter plate are formed integrally with the base. The gutter corner diverter where the gutter corner diverter is configured to be attached to a pair of rain gutters having a first rain gutter and a second rain gutter, the pair of rain gutters forming a mitered corner at an inside eave corner formed by a pair of roof eaves, the first rain gutter having a first fascia face and a first front face, the second rain gutter having a second fascia face and a second front face, the a mitered corner having an outside gutter corner formed by the first fascia face and the second fascia face positioned against the eave corner and an inside gutter corner by the first front face and the second front face, the gutter corner diverter may include the base is configured to rest on a top of a front portion of the outside gutter corner, the first attachment tab is configured to be attached to a front lip of the first front face, and the second attachment tab is configured to be attached to a front lip of the second of the front face. The gutter corner diverter where a valley is formed by a pair of roof sections and where the valley terminates proximate the eave corner, the gutter corner diverter may include the base is positioned to receiver rainwater from the valley, and the diverter plate is configured to be positioned opposite the outside gutter corner and is further configured to divert rainwater into the pair of straight rain gutters. The gutter corner diverter where the third leg has a first end that terminates proximate the first front face and a second end that terminates proximate the second front face. The gutter corner diverter where the third leg has a length and the diverter plate extends along the length of the third leg. The gutter corner diverter where the diverter plate extends beyond the length of the third leg. Implementations of the described techniques may include hardware, a method or process, or a computer tangible medium.

DETAILED DESCRIPTION

Figure 1:
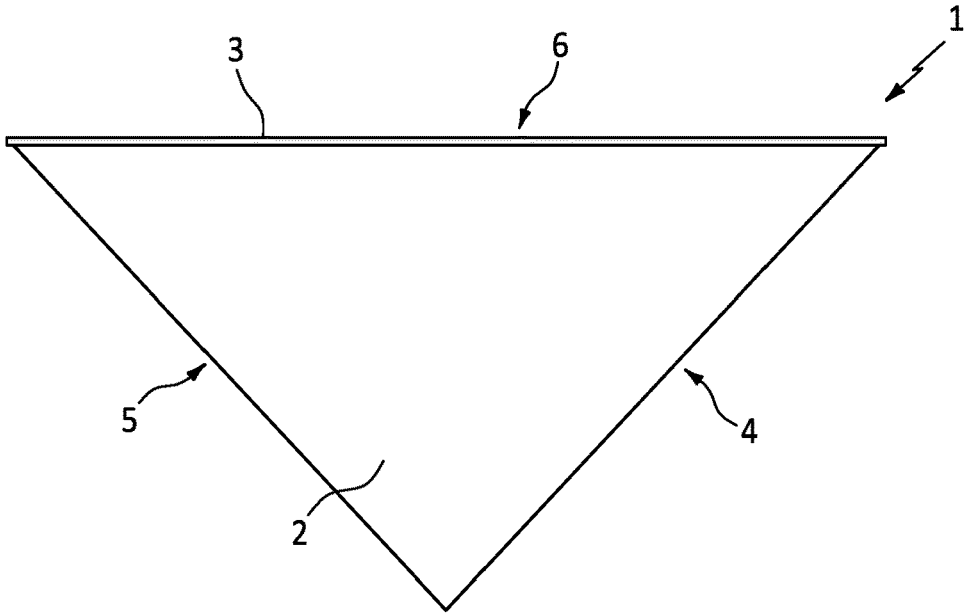
FIG. 1 is a top view of gutter corner diverter of the current disclosure.
Figure 2:
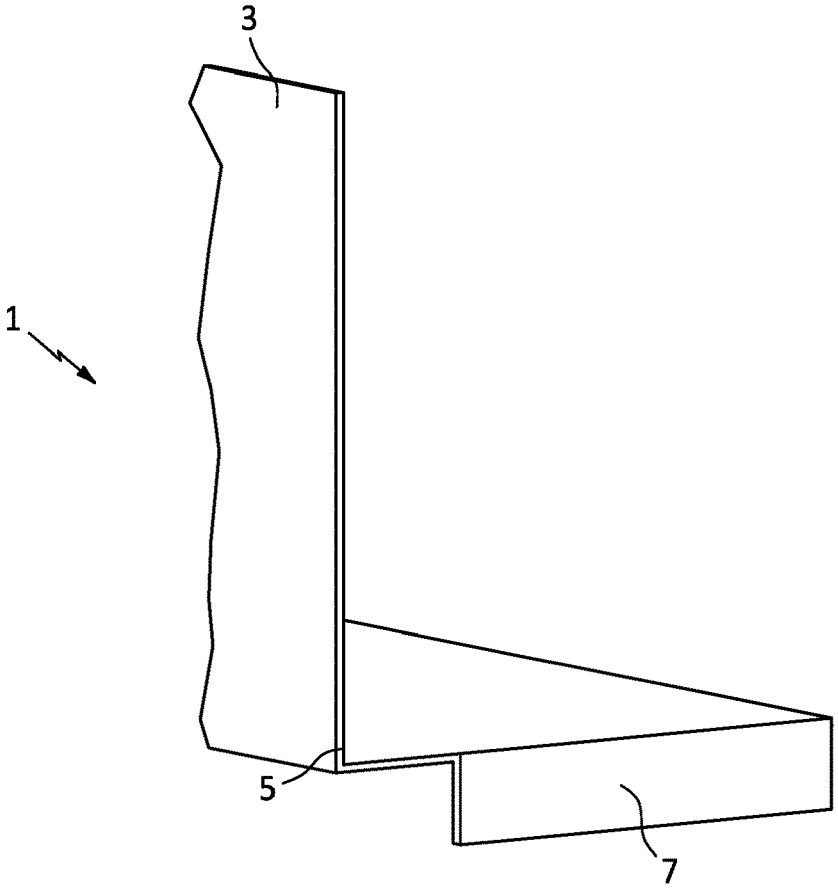
FIG. 2 is a left side view of gutter corner diverter of the current disclosure.
Figure 3:
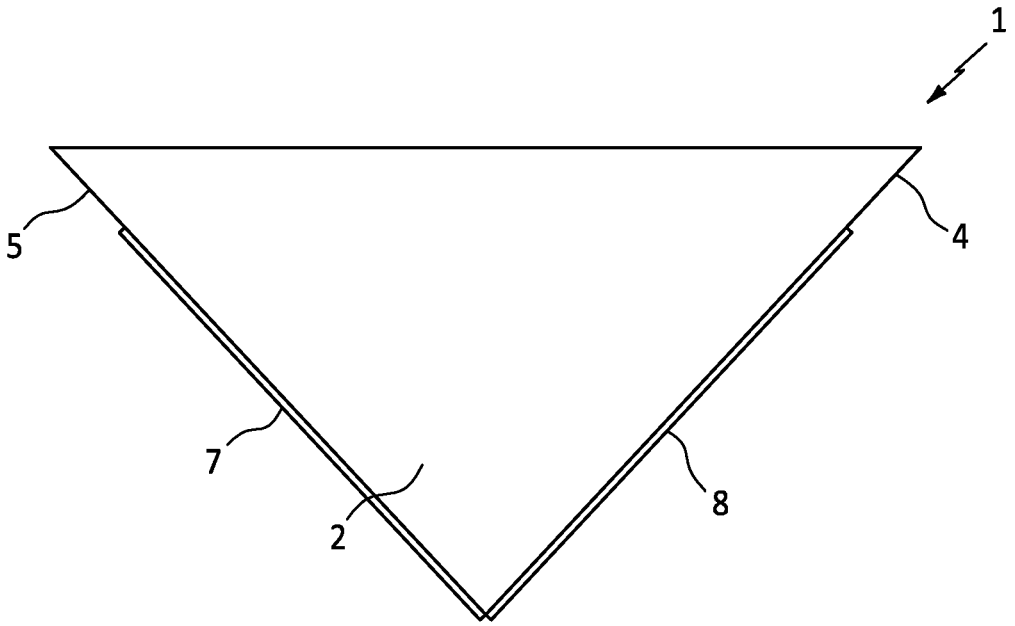
FIG. 3 is a bottom view in partial perspective of gutter corner diverter of the current disclosure.
Figure 4:
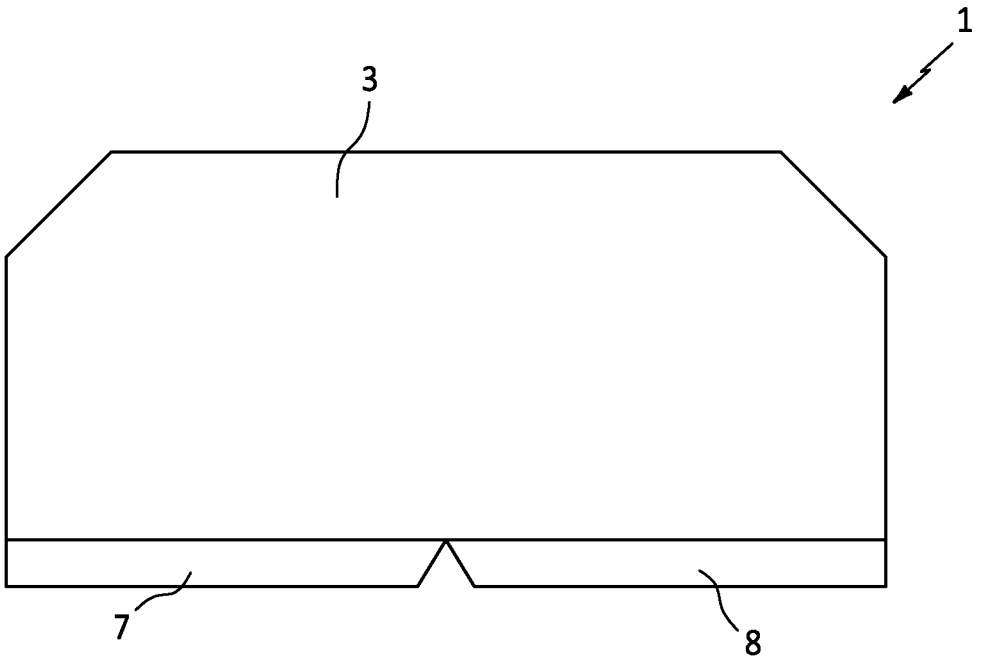
FIG. 4 is a back side view of gutter corner diverter of the current disclosure.
Figure 5:
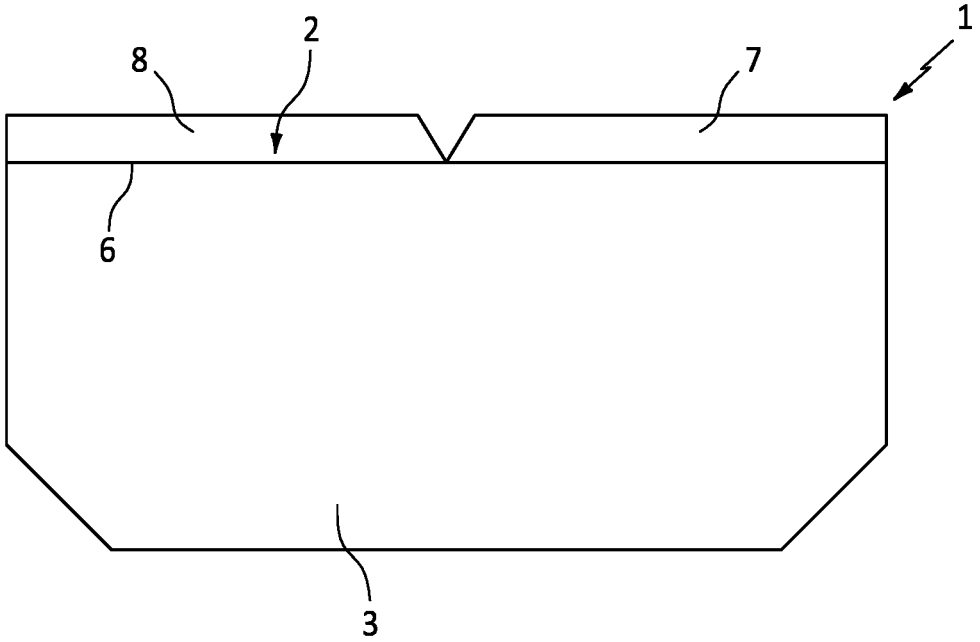
FIG. 5 is a back side view of gutter corner diverter of the current disclosure in an upside position.

FIG. 1 is a top view of gutter corner diverter 1 and includes a base 2 and a gutter corner diverter plate 3. Base 2 is generally planar and rectangular in shape having a first leg 4, a second leg 5 and a third leg 6. In the implementation shown, the angle between first leg 4 and second leg 5 is approximately 90 to accommodate a complimentary 90 degrees associated with an inside mitered corner of a rain gutter as will be disclosed in more detail herein after. Also shown is the angle between first leg 4 and third leg 6 is approximately 45 degrees and the angle between second leg 5 and third leg 6 is approximately 45 degrees to divert rainwater in a predetermined direction as will be disclosed in more detail herein after. FIG. 2 is a left side view of gutter corner diverter 1 and shows attachment tab 7 projecting downwardly from base 2 along second leg 5. FIG. 3 is a bottom view in partial perspective of gutter corner diverter 1. FIG. 4 is a back side view of gutter corner diverter 1. FIG. 5 is a back side view of gutter corner diverter 1 in an upside position. With reference to FIGS. 1-5 gutter corner diverter 1, in some implementations gutter corner diverter 1 is a unitary piece with attachment tab 7 projecting downwardly from base 2 along second leg 5 at approximately a 90 degree angle. Attachment tab 8 projecting downwardly from base 2 along first leg 4 at approximately a 90 degree angle and gutter corner diverter plate 3 projecting upwardly from base 2 along third leg 6 at approximately a 90 degree angle. Implementations of gutter corner diverter 1 comprise any suitable material such as aluminum, copper, steel, vinyl and the like.

Figure 6:
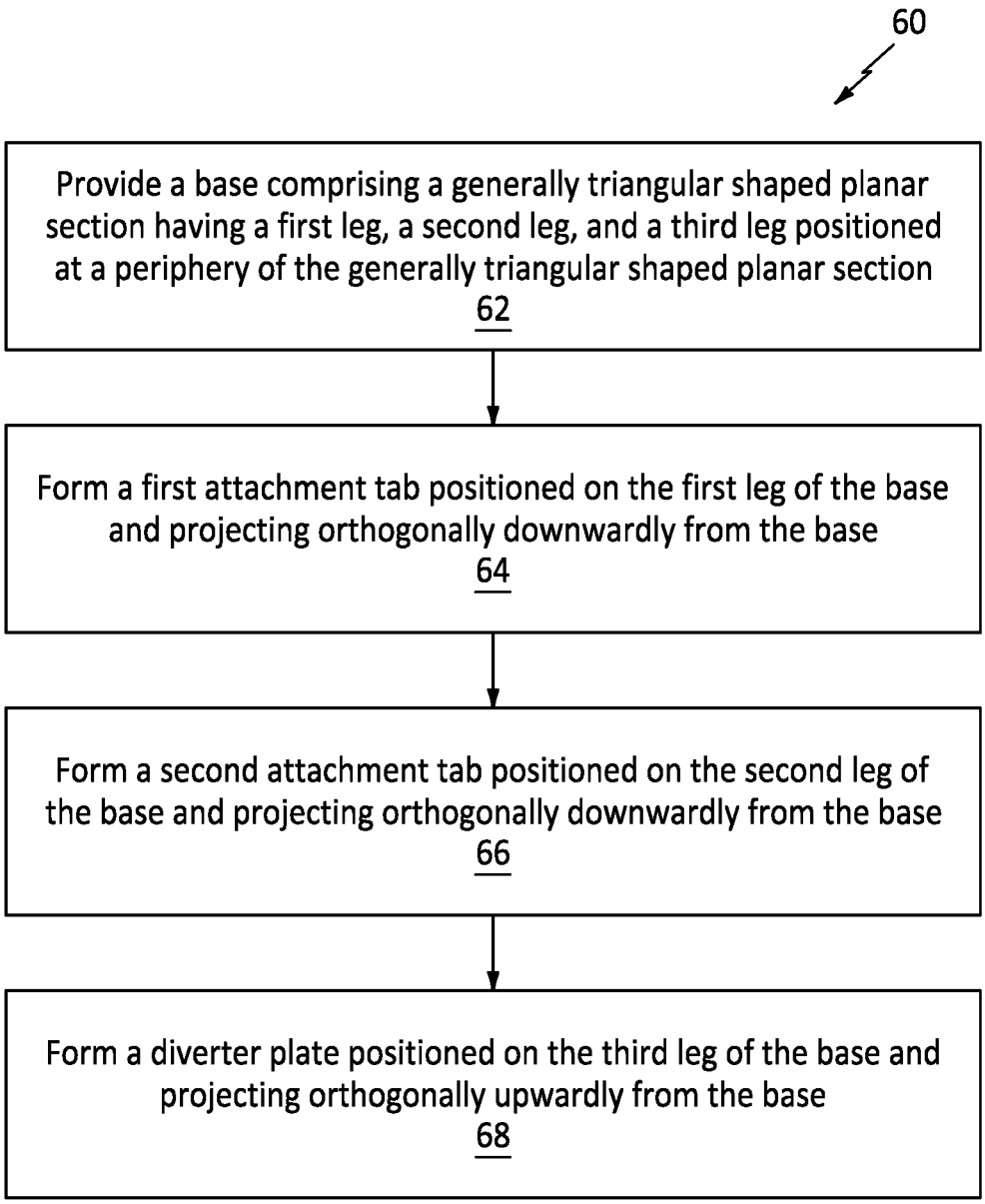
FIG. 6 is a flowchart of an example process 60 for forming a gutter corner diverter of the current disclosure.

FIG. 6 is a flowchart of an example process 60 for forming a gutter corner diverter 1. In some implementations, one or more process blocks of FIG. 6 may be performed by may be performed simultaneously to form a gutter corner diverter 1.

As shown in FIG. 6, process 60 may include providing a base 1 having a generally triangular shaped planar section having a first leg 4, a second leg 5, and a third leg 6 positioned at a periphery of the generally triangular shaped planar section (block 62). As also shown in FIG. 6, process 60 may include forming a first attachment tab 8 positioned on the first leg 4 of the base 2 and projecting orthogonally downwardly from the base (block 64). As further shown in FIG. 6, process 60 may include forming a second attachment tab 7 positioned on the second leg 5 of the base 2 and projecting orthogonally downwardly from the base (block 66). As also shown in FIG. 6, process 60 may include forming a diverter plate 3 positioned on the third leg of the base 2 and projecting orthogonally upwardly from the base (block 68).

Figure 7:
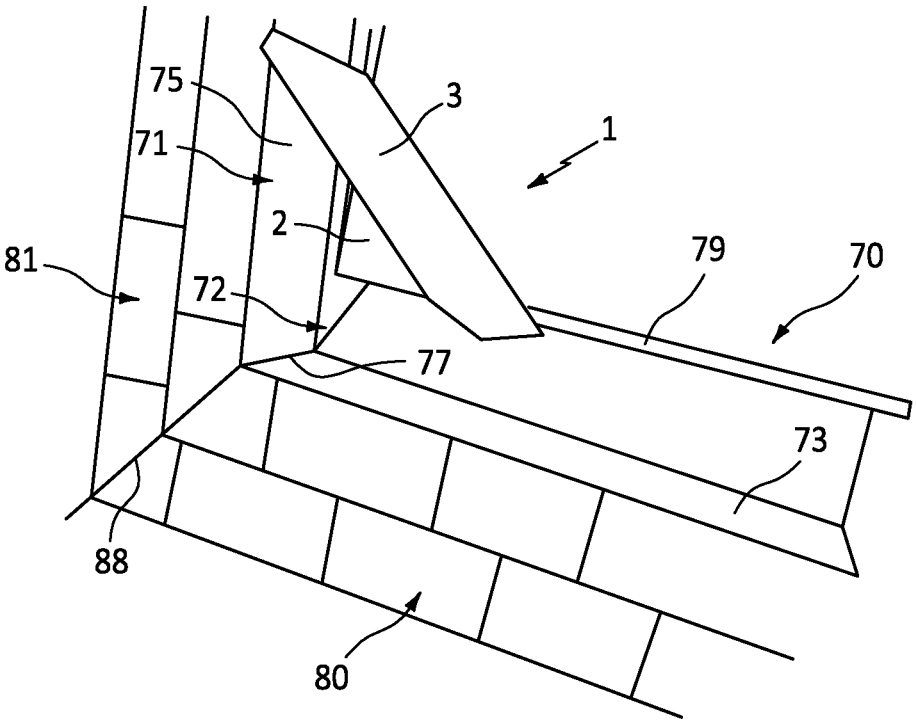
FIG. 7 is a perspective view of corner gutter diverter of the current disclosure positioned on a gutter system.
Figure 8:
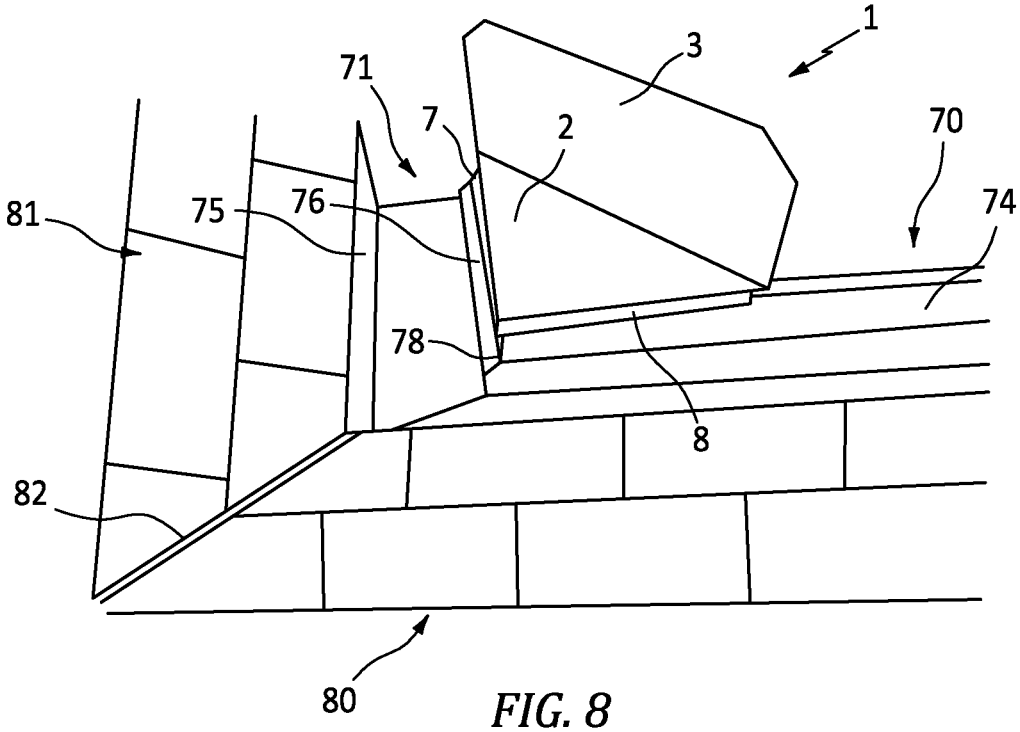
FIG. 8 is a perspective view of corner gutter diverter of the current disclosure positioned on a gutter system.

FIG. 7 is perspective view of corner gutter diverter 1 positioned on a gutter system. Similarly, FIG. 8 is perspective view of corner gutter diverter 1 positioned on a gutter system. With reference to the various figures, in the implementation shown, a pair of rain gutters may include a first rain gutter 70 and a second rain gutter 71, the pair of rain gutters form a mitered corner 72 at an inside eave corner formed by a pair of roof eaves (not shown), the first rain gutter having a first fascia face 73 and a first front face 74, the second rain gutter having a second fascia face 75 and a second front face 76, the mitered corner having an inside gutter corner 77 formed by the first fascia face 73 and the second fascia face 75 positioned against the eave corner and an outside gutter corner 78 formed by the first front face 74 and the second front face 76. As part of the installation, gutter corner diverter 1 includes positioning a portion of the base 2 on a top 79 of a front portion of the outside gutter corner 78. Corner gutter diverter is fixedly attached to the pair of rain gutters by attaching the first attachment tab 8 to a front lip of the first front face 74 and attaching the second attachment tab 7 to a front lip of the second of the front face 76. The first attachment tab 8 can be attached to a front lip of the first front face 74 and the second attachment tab 7 to a front lip of the second of the front face 76 in any known way such as by riveting, gluing, fastening, brazing, soldering or the like depending on the materials of the rain gutters and the corner gutter diverter.

It should be appreciated by those skilled in the art that inside mitered corner 72 is a typical arrangement where a first roof section 80 and a second roof section 81 intersect to form a valley 82. In operation, during a precipitation event such as a rain storm, a portion rain water that impacts first roof section 80 and second roof section 81 migrates into valley 82 and is directed toward mitered corner 72 and into the gutter pair. If the amount of rain water being directed along valley 82 is significant enough the volume and speed of the rain water may cause the rain water to over shoot the outside gutter corner 78 and wherein if not for the inventive nature of corner gutter diverter 1 it would lead to deleterious effects to persons and objects on the ground below inside mitered corner 72. It should be appreciated by those skilled in the art that in such an over shooting event because corner gutter diverter 1 is mounted on the outside of outside gutter corner 78 the rain water would at least partially be received by base 2 of the corner gutter diverter and impact diverter plate 3 and be diverted into the pair of straight rain gutters 70, 71 thus ameliorating the aforementioned deleterious effects. It should further be appreciated by those skilled in the art that the lengths of first leg 4 and second leg 5, as well as the height of diverter plate 3 are chosen to capture the volume of rain water and the distance that such rain water over shoots outside gutter corner 78 will be diverted back into the rain gutter pair by corner gutter diverter 1.

In some implementations the angle between first leg 4 and second leg 5 may be angle other than 90 degrees and may be configured to match the angle of outside gutter corner 78. In other implementations first leg 4 and second leg 5 may comprise different lengths. For example, in situations where it may be advantageous to divert a greater portion of the rain water to first rain gutter 70 and a lesser portion to second rain gutter 71 first leg 4 may be longer than second leg 5. In this implementation diverter plate 3 is placed in a position more closely aligned with first front face 74 and dividing the rain water accordingly.

It should be appreciated by those skilled in the art that corner gutter diverter 1 can accommodate a plethora of prior art rain gutters comprising a variety materials and front face shapes. It should further be appreciated by those skilled in the art that corner gutter diverter 1 can be used with other gutter systems such as gutter debris systems without modifications to such systems. Except for the low profile of first attachment tab 8 second attachment tab 7, the mounting scheme disclosed herein above does not obstruct the open channels of the straight section gutter pair. In other implementations diverter plate 3 may be angled across the top of the diverter plate.

Figure 9:
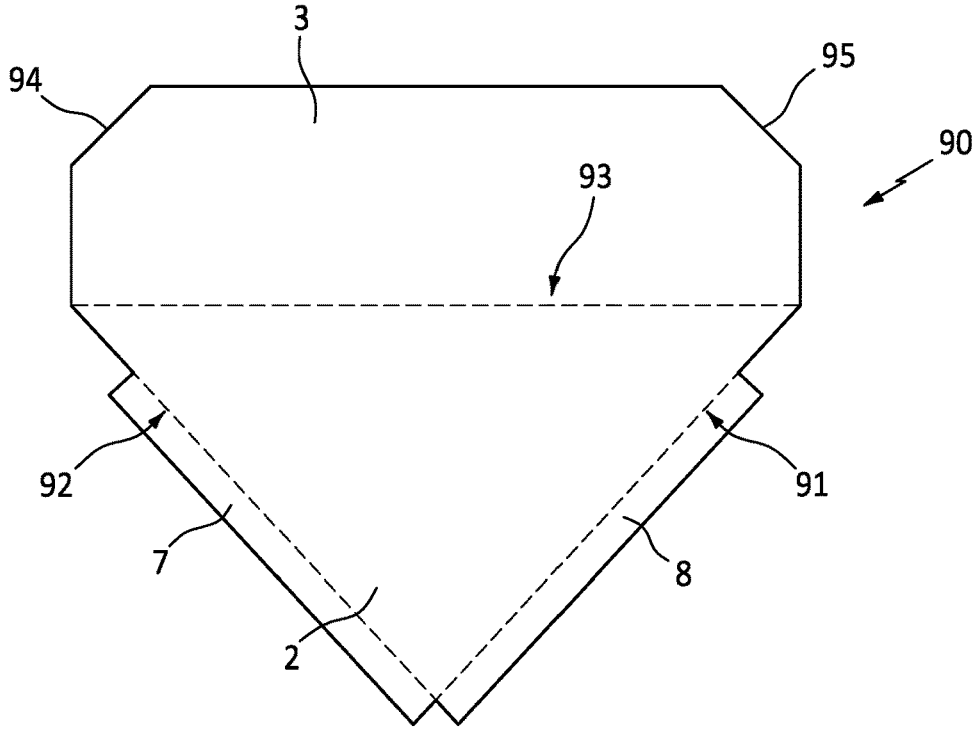
FIG. 9 is top view of a universal blank for a corner gutter diverter of the current disclosure.

FIG. 9 shows another implementation of the present disclosure wherein a universal blank 90 can be used to form diverter 1 of the previous implementations. In this implementation, universal blank 90 includes score lines 91, 92, 93. Score line 91 allows for a user to form attachment tab 8 by bending the attachment tab in either the upward direction or downward direction. Similarly score line 92 allows for a user to form attachment tab 7 by bending the attachment tab in either the upward direction or downward direction but in the same direction as attachment tab 8. Score line 93 allows for a user to form diverter plate 8 by bending the diverter plate in either the upward direction or downward direction but in the direction opposite that of attachment tabs 7, 8. It should also be observed that diverter plate 3 may include chamfers 94, 95 to remove sharp corners and improve the handling and safety of the corner gutter diverter 1.

Figure 10:
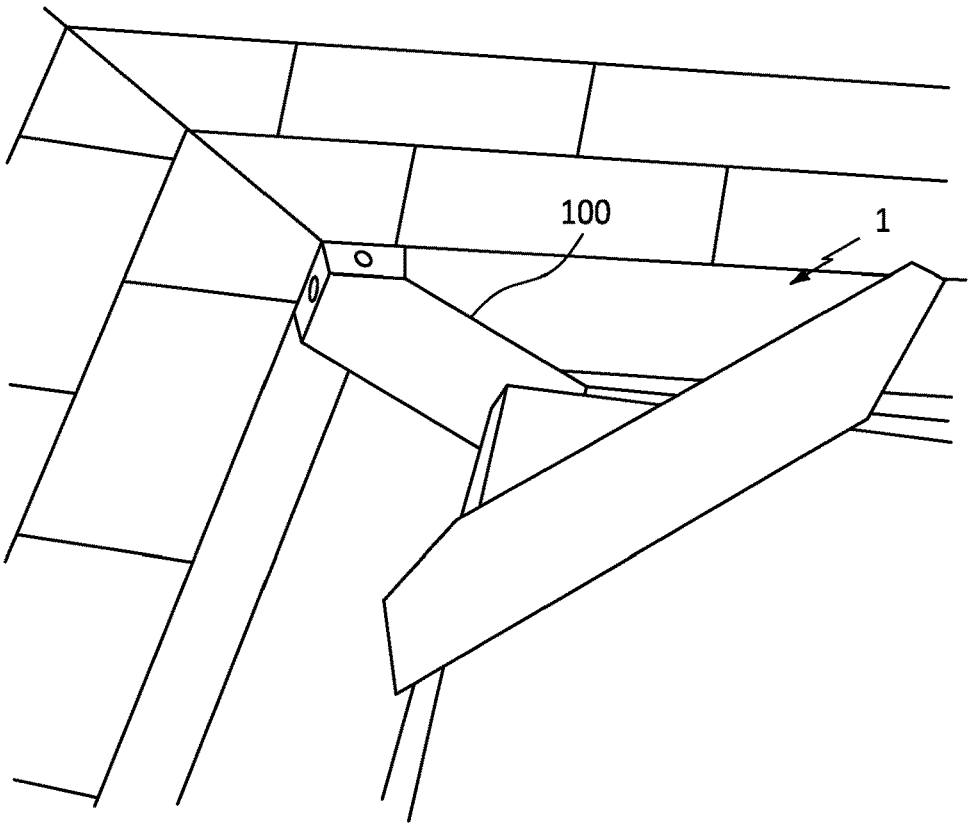
FIG. 10 is a perspective view of a debris guard support of the current disclosure.

FIG. 10 is an isometric view corner gutter diverter 1 which includes debris guard support 100. Debris guard support 100 attaches to attachment tabs 7, 8 and to first fascia face 73 and second fascia face 74 such that debris guard support is positioned parallel to, and slightly below, base 2. It should be appreciated by those skilled in the art that debris guard support 100 advantageously provides support for a prior art debris guard (such as a lead protection system) that lays flat in a rain gutter.

Figure 11:
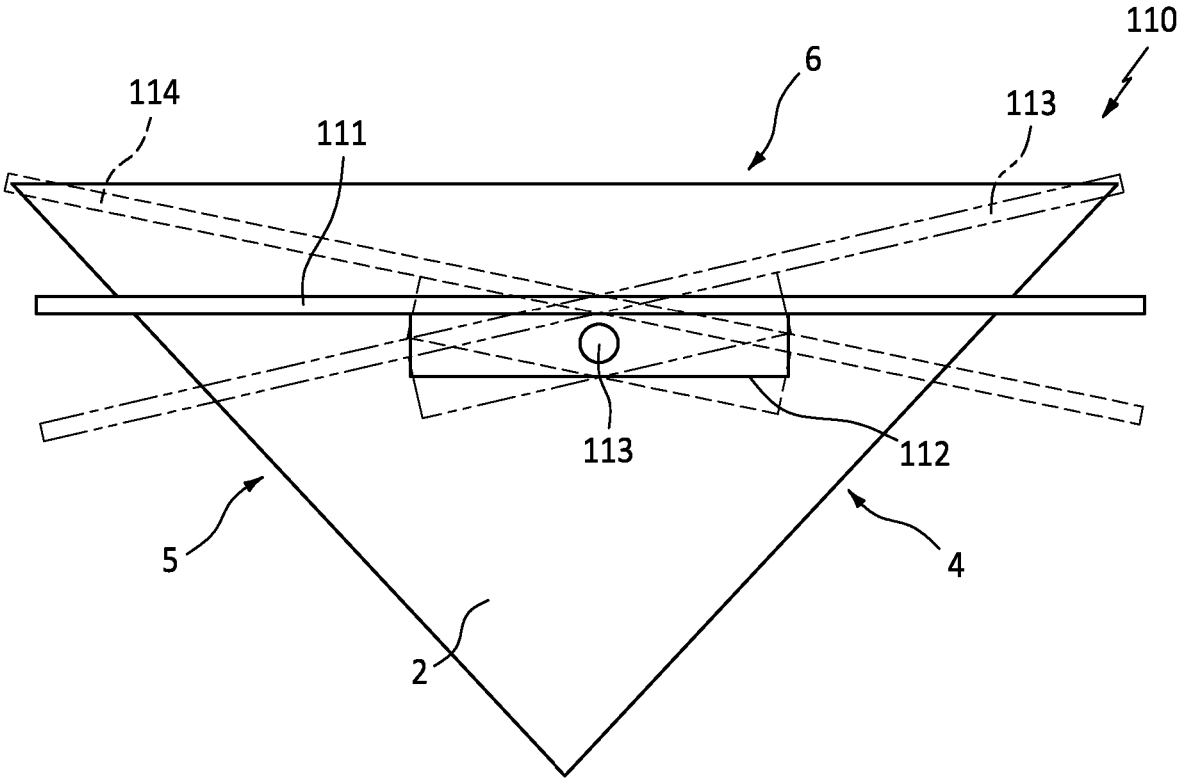
FIG. 11 is a top view of a corner gutter diverter of the current disclosure having an adjustable diver plate.

FIG. 11 is a top view of adjustable corner gutter diverter 110 which includes adjustable diverter plate 111 mounting tab 112 and fastener 113. Adjustable diverter plate 111 is similar to diverter plate 2 disclosed herein above and includes mounting tab 112 formed integrally with, and orthogonally positioned to, the diverter plate. In the implementation, mounting tab 112 and base 2 include concentrically aligned through holes (not shown) through which fastener 113 is positioned. As it will be appreciated by those skilled in the art, adjustable diverter plate 111 can be almost infinitely adjusted between the positioned shown and angled to the left position 114 and the right position 114 and once positioned in the desired orientation fastener 113 can be tightened to fixedly hold the adjustable diverter plate in the desired positioned.

The foregoing disclosure provides illustration and description but is not intended to be exhaustive or to limit the implementations to the precise form disclosed. Modifications may be made in light of the above disclosure or may be acquired from practice of the implementations. As used herein, the term "component" is intended to be broadly construed as hardware, firmware, or a combination of hardware and software. It will be apparent that systems and/or methods described herein may be implemented in different forms of hardware, firmware, and/or a combination of hardware and software. The actual specialized control hardware or software code used to implement these systems and/or methods is not limiting of the implementations. Thus, the operation and behavior of the systems and/or methods are described herein without reference to specific software code—it being understood that software and hardware can be used to implement the systems and/or methods based on the description herein. As used herein, satisfying a threshold may, depending on the context, refer to a value being greater than the threshold, greater than or equal to the threshold, less than the threshold, less than or equal to the threshold, equal to the threshold, and/or the like, depending on the context. Although particular combinations of features are recited in the claims and/or disclosed in the specification, these combinations are not intended to limit the disclosure of various implementations. In fact, many of these features may be combined in ways not specifically recited in the claims and/or disclosed in the specification.

Although each dependent claim listed below may directly depend on only one claim, the disclosure of various implementations includes each dependent claim in combination with every other claim in the claim set. No element, act, or instruction used herein should be construed as critical or essential unless explicitly described as such. Also, as used herein, the articles "a" and "an" are intended to include one or more items and may be used interchangeably with "one or more." Further, as used herein, the article "the" is intended to include one or more items referenced in connection with the article "the" and may be used interchangeably with "the one or more." Furthermore, as used herein, the term "set" is intended to include one or more items (e.g., related items, unrelated items, a combination of related and unrelated items, and/or the like), and may be used interchangeably with "one or more." Where only one item is intended, the phrase "only one" or similar language is used. Also, as used herein, the terms "has," "have," "having," or the like are intended to be open-ended terms. Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A method of providing for a gutter corner diverter comprising:

providing a base configured to be mounted to an outside of a gutter corner, the base comprising a generally triangular shaped planar section having a first leg, a second leg, and a third leg positioned at a periphery of the generally triangular shaped planar section;

forming a first attachment tab positioned on the first leg of the base and projecting orthogonally downwardly from the base configured to be positioned against an inside front lip of a first gutter;

forming a second attachment tab positioned on the second leg of the base and projecting orthogonally downwardly from the base configured to be positioned against an inside front lip of a second gutter; and forming a diverter plate positioned on the third leg of the base and projecting orthogonally upwardly from the base.

2. The method of providing for a gutter corner diverter of claim 1 further comprising:

forming the first attachment tab, forming the second attachment tab and forming the diverter plate integrally with the base.

3. The method of providing for a gutter corner diverter of claim 1 further comprising attaching the gutter corner diverter to a pair of rain gutters, wherein the pair of rain gutters comprises a first rain gutter and a second rain gutter, the pair of rain gutters forming a mitered corner at an inside eave corner formed by a pair of roof eaves, the first rain gutter having a first fascia face and a first front face, the second rain gutter having a second fascia face and a second front face, the mitered corner having an inside gutter corner formed by the first fascia face and the second fascia face positioned against the inside eave corner and an outside gutter corner formed by the first front face and the second front face, the method of providing for a gutter corner diverter further comprising:

positioning a portion of the base on a top of a front portion of the outside gutter corner;

attaching the first attachment tab to a front lip of the first front face; and attaching the second attachment tab to a front lip of the second front face.

4. The method of providing for a gutter corner diverter of claim 3 wherein a valley is formed by a pair of roof sections and wherein the valley terminates proximate the inside eave corner, the method of providing for a gutter corner diverter further comprising:

positioning the base to receiver rainwater from the valley;

positioning the diverter plate opposite the inside gutter corner; and diverting rainwater from the base to the diverter plate and into the pair of straight rain gutters.

5. The method of providing for a gutter corner diverter of claim 4 further comprising terminating a first end of the third leg proximate the first front face and terminating a second end of the third leg proximate the second front face.

6. The method of providing for a gutter corner diverter of claim 5 wherein the third leg has a length the method further comprising extending the diverter plate along at least a portion of the length of the third leg.

7. The method of providing for a gutter corner diverter of claim 6 further comprising extending the diverter plate beyond the length of the third leg.

8. A device comprising:

a base comprising a generally triangular shaped planar section having a first leg, a second leg, and a third leg positioned at a periphery of the generally triangular shaped planar section;

a first attachment tab positioned on the first leg of the base and projecting orthogonally downwardly from the base;

a second attachment tab positioned on the second leg of the base and projecting orthogonally downwardly from the base;

a diverter plate positioned on the third leg of the base and projecting orthogonally upwardly from the base;

the device configured to be attached to a pair of rain gutters, wherein the pair of rain gutters comprises a first rain gutter and a second rain gutter, the pair of rain gutters forming a mitered corner at an inside eave corner formed by a pair of roof eaves, the first rain gutter having a first fascia face and a first front face, the second rain gutter having a second fascia face and a second front face, the mitered corner having an inside gutter corner formed by the first fascia face and the second fascia face positioned against the inside eave corner and an outside gutter corner formed by the first front face and the second front face, the device further comprising:

the first attachment tab is configured to be positioned against an inside front lip of the first rain gutter;

the second attachment tab is configured to be positioned against an inside front lip of the second rain gutter; and a portion of the base is configured to be positioned on a top of a front portion of the outside gutter corner and is further configured to be attached to the top of the front portion of the outside gutter corner.

9. The device of claim 8, further comprising the first attachment tab, the second attachment tab and the diverter plate formed integrally with the base.

10. The device of claim 8, wherein a valley is formed by a pair of roof sections and wherein the valley terminates proximate the inside eave corner, the device further comprising:

the base is configured to be positioned to receiver rainwater from the valley;

the diverter plate is configured to be positioned opposite the inside gutter corner; and the device is configured to divert rainwater from the base to the diverter plate and into the pair of straight rain gutters.

11. The device of claim 10, further comprising a first end of the third leg is terminated proximate the first front face and a second end of the third leg is terminated proximate the second front face.

12. The device of claim 11, wherein the third leg has a length extending the diverter plate along at least a portion of the length of the third leg.

13. The device of claim 12, wherein the diverter plate extends beyond the length of the third leg.

14. A gutter corner diverter comprising:

a base comprising a generally triangular shaped planar section having a first leg, a second leg, and a third leg positioned at a periphery of the generally triangular shaped planar section;

a first attachment tab positioned on the first leg of the base and projecting orthogonally downwardly from the base configured to be positioned against an inside front lip of a first rain gutter;

a second attachment tab positioned on the second leg of the base and projecting orthogonally downwardly from the base to be positioned against an inside front lip of a second rain gutter; and a diverter plate positioned on the third leg of the base and projecting orthogonally upwardly from the base.

15. The gutter corner diverter of claim 14 further comprising the first attachment tab, the second attachment tab and the diverter plate are formed integrally with the base.

16. The gutter corner diverter of claim 14 wherein the first rain gutter and the second rain gutter comprise a pair of rain gutters, the pair of rain gutters forming a mitered corner at an inside eave corner formed by a pair of roof eaves, the first rain gutter having a first fascia face and a first front face, the second rain gutter having a second fascia face and a second front face, the mitered corner having an outside gutter corner formed by the first fascia face and the second fascia face positioned against the inside eave corner and an inside gutter corner by the first front face and the second front face, the gutter corner diverter further comprising:

the base is configured to rest on a top of a front portion of the outside gutter corner and is further configured to be attached to the top of the front portion of the outside gutter corner.

17. The gutter corner diverter of claim 16 the gutter corner diverter further comprising:

the base is positioned to receiver rainwater from the inside eave corner; and the diverter plate is configured to be positioned opposite the outside gutter corner and is further configured to divert rainwater into the pair of straight rain gutters.

18. The gutter corner diverter of claim 17 wherein the third leg has a first end that terminates proximate the first front face and a second end that terminates proximate the second front face.

19. The gutter corner diverter of claim 18 wherein the third leg has a length and the diverter plate extends along the length of the third leg.

20. The gutter corner diverter of claim 19 wherein the diverter plate extends beyond the length of the third leg.

* * * * *